US006551377B1

(12) United States Patent
Leonhardt

(10) Patent No.: US 6,551,377 B1
(45) Date of Patent: Apr. 22, 2003

(54) SPHERICAL RHENIUM POWDER

(75) Inventor: Todd A. Leonhardt, Medina, OH (US)

(73) Assignee: Rhenium Alloys, Inc., Elyria, OH (US)

( * ) Notice: Subject to any disclaimer, the term of this patent is extended or adjusted under 35 U.S.C. 154(b) by 0 days.

(21) Appl. No.: 09/681,330

(22) Filed: Mar. 19, 2001

(51) Int. Cl.[7] ..... B22F 1/00
(52) U.S. Cl. ..... 75/255
(58) Field of Search ..... 75/255, 346

(56) References Cited

U.S. PATENT DOCUMENTS

| | | | | | |
|---|---|---|---|---|---|
| 3,375,109 | A | | 3/1968 | Peters | 75/212 |
| 4,390,368 | A | * | 6/1983 | Houck | |
| 4,687,510 | A | | 8/1987 | Cheney et al. | 75/0.5 B |
| 4,731,111 | A | * | 3/1988 | Kopatz et al. | |
| 4,773,928 | A | | 9/1988 | Houck et al. | 75/0.5 R |
| 4,783,218 | A | * | 11/1988 | Kemp, Jr. et al. | |
| 4,915,733 | A | * | 4/1990 | Schutz et al. | 75/228 |
| 4,981,512 | A | * | 1/1991 | Kapoor | 75/248 |
| 5,173,108 | A | | 12/1992 | Houck | 75/365 |
| 5,200,595 | A | | 4/1993 | Boulos et al. | 219/121.52 |
| 5,294,242 | A | | 3/1994 | Zurecki et al. | 75/345 |
| 5,372,661 | A | * | 12/1994 | Felix et al. | 148/423 |
| 5,720,451 | A | | 2/1998 | Chazen et al. | 244/172 |
| 5,897,962 | A | | 4/1999 | Houck et al. | 428/548 |

OTHER PUBLICATIONS

Tekna Plasma Systems, Inc., "Induction Plasma Systems," information downloaded from web site (http://www-.tekna.qc.ca/index.html), original publication date and author presently unknown.

T. Leonhardt et al., "Spherical Rhenium Metal Powder," presented at the 15$^{th}$ Annual Plansee Seminar in Reutte, Austria, on May 30, 2001.

Leonhardt et al., "Near Net Shape of Powder Metallurgy Rhenium Parts," presented at the 15$^{th}$ Annual Plansee Seminar in Reutte, Austria on May 30, 2001.

Leonhardt et al., "Advances in Powder Metallurgy Rhenium," 25$^{th}$ Annual Conference on Composites, Material and Structures, Cape Canaveral/Cocoa Beach, Florida, Jan. 24, 2001.

Carlén, "Mill Products and Fabricated Components in Rhenium Metal and Rhenium Rich Alloys," Rhenium and Rhenium Alloys, The Minerals, Metals & Materials Society, 1997, pp. 49–57.

Milewski et al., "Directed Light Fabrication of Rhenium Components," Rhenium and Rhenium Alloys, The Minerals, Metals & Materials Society, 1997, pp. 283–290.

Bryskin et al., "Development of Process Parameters for Manufacturing of Near–Net Shape Parts of Rhenium Using Hot Isostatic Pressing," Rhenium and Rhenium Alloys, The Minerals, Metals & Materials Society, 1997, pp. 425–436.

Bryskin et al., "Powder Processing and the Fabrication of Rhenium," Journal of the Minerals, Metals & Materials Society, vol. 43, No. 7, Jul. 1991, pp. 24–26.

* cited by examiner

*Primary Examiner*—Ngoclan Mai
(74) *Attorney, Agent, or Firm*—Rankin, Hill, Porter & Clark, LLP

(57) ABSTRACT

This invention relates to powders of substantially spherical particles that consist essentially of at least about 10% by weight rhenium optionally alloyed with up to about 90% by weight tungsten or up to about 60% by weight molybdenum. In one embodiment, the spherical particles have an average diameter of less than about 150 microns, and more preferably, an average diameter within the range of from about 10 to about 50 microns. The powders according to the invention exhibit good flow characteristics and can be used to fabricate components having complicated shapes and configurations using conventional powder metallurgy techniques.

9 Claims, No Drawings

SPHERICAL RHENIUM POWDER

BACKGROUND OF INVENTION

This invention relates to substantially spherical powders of rhenium optionally alloyed with tungsten or molybdenum and the process by which such powders are produced.

Rhenium (mp 3,180° C.; D 21.04 g/cc) is a refractory metal that has no known ductile-to-brittle transition temperature and a high modulus of elasticity. Components formed from rhenium can withstand repeated heating and cooling cycles without incurring mechanical damage. For these and other reasons, rhenium is often used to manufacture thrust chambers and nozzles for rockets used on spacecraft and other critical components. An example of a thrust chamber having a body formed of rhenium is disclosed in Chazen et al., U.S. Pat. No. 5,720,451.

It is well known that rhenium can be alloyed with tungsten or molybdenum to impart improved ductility and other desirable properties to such materials. Alloys of rhenium and molybdenum typically containing 41–47.5% by weight rhenium are used in the electronics, aerospace, and nuclear industries. Alloys of rhenium and tungsten typically containing 3–5% or 26% by weight rhenium are used, for example, in the electronics industry as filaments and thermocouples.

Rhenium is derived primarily from the roasting of molybdenum concentrates generated in the copper mining industry. During the roasting of molybdenite, rhenium is oxidized and carried off in the flue gases. These gases are scrubbed to remove the rhenium, which is then recovered in solution using an ion exchange process. The rhenium solution is then treated and neutralized with ammonium hydroxide to precipitate ammonium perrhenate. Ammonium perrhenate can be reduced in a hydrogen atmosphere to form rhenium metal powder.

Rhenium metal powder derived in the manner thus described consists of discrete particles that have a random shape and an uneven surface texture. The particles, when viewed under high magnification, resemble flakes. For purposes of clarity, throughout the instant specification and in the appended claims such material shall be referred to as rhenium powder flakes.

Rhenium powder flakes exhibit very poor flow characteristics, have a relatively low density (typically only 15% of theoretical density), and contain approximately 1,000 ppm or more of oxygen. Due to these inherent properties and characteristics, it has heretofore been very difficult to manufacture rhenium components via conventional powder metallurgy techniques. In general, only relatively simple shapes such as rods, bars, plates, and sheets could be produced. To produce complex shapes, rhenium in the form of these simple shapes had to be machined to specified dimensions and tolerances. The machining of rhenium is also problematic and it results in the creation of a significant amount of scrap, which is extremely cost ineffective. Numerous attempts to produce components of complex shape using near-net-shape powder metallurgy techniques have met with very limited success over the years. Some of the problems associated with the fabrication of products using rhenium powder flakes are discussed in an article entitled Mill Products and Fabricated Components in Rhenium Metal and Rhenium Rich Alloys, by Jan-C. Carl én, Rhenium and Rhenium Alloys, B. D. Bryskin, Editor, The Minerals, Metals & Materials Society, 1997, p. 49–57, which is hereby incorporated by reference.

It would be highly desirable to be able to produce rhenium and rhenium alloy components having complex shapes using conventional near-net-shape powder metallurgy manufacturing techniques such as, for example, vacuum plasma spraying, direct-hot isostatic pressing, directed light fabrication, and metal injection molding. In order to use these techniques, special powders are needed. Such powders should exhibit good flow characteristics, have a higher density than rhenium powder flakes, and should preferably contain a minimum amount of oxygen.

SUMMARY OF INVENTION

The present invention provides powders comprising substantially spherical particles consisting essentially of at least about 10% by weight rhenium optionally alloyed with up to about 90% by weight tungsten or up to about 60% by weight molybdenum. Preferably, the spherical particles have an average diameter of less than about 150 microns, and more preferably, an average diameter within the range of from about 10 to about 50 microns. The powders can also have a bimodal or multi-modal particle size distribution. The powders according to the invention exhibit good flow characteristics and can be used to fabricate components of complex shape using conventional powder metallurgy techniques.

In one embodiment of the invention, the spherical particles consist essentially of rhenium. In another embodiment, the spherical particles consist essentially of an alloy of from about 15% to about 35% by weight rhenium with the balance being tungsten. In yet another embodiment, the spherical particles consist essentially of an alloy of from about 35% to about 60% by weight rhenium with the balance being molybdenum.

The spherical powders according to the invention exhibit excellent flow characteristics. In addition, the spherical powders according to the invention have a significantly greater density than powder flakes. Moreover, the spherical powders according to the invention have a reduced oxygen content as compared to powder flakes. Thus, the spherical powders according to the invention are particularly well-suited for use in conventional powder metallurgy techniques such as, for example, vacuum plasma spraying, direct-hot isostatic pressing, directed light fabrication, and metal injection molding.

The present invention also relates to a process for producing a powder comprising substantially spherical metal particles. The process comprises: providing flakes consisting essentially of at least about 10% by weight rhenium and optionally up to about 90% by weight tungsten or up to about 60% by weight molybdenum; entraining said flakes in a stream of gas for transport to an induction plasma torch; creating a plasma in said stream of gas to melt said flakes into droplets; permitting said droplets to cool so as to form discrete substantially spherical solid particles; and collecting said particles. In one embodiment, the process can be used to manufacture about 70 g. of powder per minute.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION

As noted above, the flakes used in the process consist essentially of at least 10% by weight rhenium and optionally up to about 90% by weight tungsten or up to about 60% by weight molybdenum. Rhenium powder flakes can be obtained via the reduction of ammonium perrhenate in a hydrogen atmosphere as described in an article entitled Powder Processing and the Fabrication of Rhenium, by Boris D. Bryskin and Frank C. Danek, Journal of Materials, Jul. 19, 1991, pages 24–26, which is hereby incorporated by reference. Peters et al., U.S. Pat. No. 3,375,109, which is also hereby incorporated by reference, discloses methods of obtaining pre-alloyed powders of rhenium and tungsten or molybdenum.

Rhenium powder flakes can more conveniently be obtained from Rhenium Alloys, Inc. of Elyria, Ohio, which sells rhenium powder flakes in several grades and particle sizes. The −200 mesh powder metallurgical grade of rhenium powder flake possesses a purity of 99.99%, an average particle size of about 3.5 $\mu$m, an apparent density of about 1.84 g/cm$^3$, and a tap density of about 3.03 g/cm$^3$. As noted above, rhenium powder flakes of this type have a rough surface texture and thus exhibit poor flow characteristics.

An induction plasma torch must be used to prepare the powders according to the invention. The preferred induction plasma torches for use in the process of the present invention are available from Tekna Plasma Systems, Inc. of Sherbrooke, Quebec, Canada. Boulos et al., U.S. Pat. No. 5,200,595, is hereby incorporated by reference for its teachings relative to the construction and operation of plasma induction torches. It is important that the induction plasma torch used in the process be equipped with a powder feeder that operates by entraining the powder flakes in a stream of gas for transport to the plasma induction torch. The transport gas should be inert, and it should preferably aid in the scavenging of oxygen. In the preferred embodiment of the process according to the invention, the transport gas is a mixture of about 80–90% argon, with the balance being hydrogen. The spherical particles thus produced will preferably contain less than about 300 ppm oxygen.

An induction plasma torch includes a reaction zone through which the entrained flakes pass. The reaction zone temperature is preferably well above the melting point of the highest melting component and preferably below the vaporization point of the lowest vaporizing component of the material to enable a relatively short residence time in the reaction zone. As the he flakes pass through the reaction zone, they melt, at least in part, to form droplets. Preferably, the flakes pass through the torch at a flow rate that minimizes interparticle contact and coalescence and permits at least the outer surfaces of the flakes to be melted. Applicants have found it possible to feed flakes through the induction plasma torch at a rate of up to about 4.2 kg/hr without problems.

Because the flakes are melted while entrained in a gas, they form substantially spherical droplets of molten metal that have a smooth outer surface. After melting, the droplets fall through a distance sufficient to permit cooling and at least partial solidification prior to contact with a solid surface or each other. If the droplets are not cooled at a rate sufficient to solidify at least an outer surface thereof prior to contact with a solid surface, such as the wall of a collection chamber or each other, the droplets will lose their sphericity and discrete integrity. While any of several methods may be used to achieve this result, it has been found convenient to feed the molten droplets while still entrained in the transport gas into a liquid cooled chamber containing a gaseous atmosphere. The chamber may also conveniently The powders according to the invention comprise substantially spherical particles consisting essentially of at least about 10% by weight rhenium optionally alloyed with up to about 90% by weight tungsten or up to about 60% by weight molybdenum. Thus, in one embodiment of the invention the powders comprise substantially spherical particles consisting essentially of rhenium. In another embodiment of the invention, the powders comprise spherical particles consisting essentially of an alloy of from about 15% to about 35%, or about 25%, by weight rhenium with the balance being tungsten. In yet another preferred embodiment of the invention, the powders comprise spherical particles consisting essentially of an alloy of from about 35% to about 60%, or about 41% to about 47.5%, by weight rhenium with the balance being molybdenum.

Preferably, the spherical particles have an average diameter of less than about 150 microns, which is suitable for use in many conventional powder metallurgy techniques. However, it will be appreciated that spherical particles having a larger average diameter such as, for example, 100 to 300 microns or greater, are suitable for other powder fabrication techniques such as, for example, laser additive manufacturing. In the presently most preferred embodiment of the invention, the spherical particles preferably have an average diameter of from about 10 to about 50 microns, which is generally considered to be optimal for use in powder injection molding and other conventional powder metallurgy techniques.

It will be appreciated that the powders can have a bimodal or multi-modal particle size distribution. For example, to improve packing density, a powder may be used that consists of 70 parts by weight of a powder having an average particle diameter of about 25 to 50 microns blended with 30 parts by weight of a powder having an average particle diameter of about 5 to 15 microns.

The powders according to the invention exhibit excellent flow characteristics. Preferably, the powders have a Hall flow within the range of from about 3 to about 10 seconds for a 50 g. sample. The particles are also substantially more dense than flakes. For example, rhenium powder flakes have a tap density of from about 2.5 to about 3.2 g/cc, whereas powders according to the present invention comprising spherical particles consisting essentially of rhenium have a tap density of from about 12 to about 13.5 g/cc.

The size of the flakes that are passed through the induction plasma torch determine, in large part, the diameter and size distribution of the spherical particles produced. Preferably, a "cut" of particularly sized flakes is used so as to produce spherical particles having a desired average particle size within an acceptable standard deviation. For example, flakes that will pass through 80 mesh sieve but not through 140 mesh sieve will generally produce spherical particles having an average diameter of from about 60 to about 90 microns with a standard deviation of less than about 35 microns. Flakes that will pass through a 140 mesh sieve but not through a 325 mesh sieve will generally produce spherical particles having an average diameter of from about 30 to about 40 microns with a standard deviation of less than about 20 microns. Flakes that will pass through a 200 mesh sieve but not through a 400 mesh sieve will generally produce spherical particles having an average diameter of from about 20 to about 30 microns with a standard deviation of less than about 10 microns. And, flakes that will pass through a 200 mesh sieve but not through a 635 mesh sieve will generally produce spherical particles having an average diameter of from about 5 to about 15 microns with a standard deviation of less than about 7 microns. It will be appreciated that other cuts can be used to produce spherical particles having desired average diameters and distributions.

Applicants have discovered that if the very small flake particles, which are commonly referred to as "fines", are not cut from the powder that is fed to the induction plasma torch, such fines can interfere with the formation of substantially spherical particles.

When the composition of the flakes used in the process consists essentially of rhenium, the bulk density of the spherical powder produced is preferably within the range of from about 50% to about 70% of the theoretical density of rhenium. The oxygen content of the powder will generally be less than about 300 ppm. And, the tap density of the powder will be within the range of from about 10 to about 14 g/cc.

The powders according to the present invention are suitable for use in powder injection molding and other powder metallurgy processes. The excellent flow, higher density, and low oxygen content of the spherical powder facilitates the near-net-shape fabrication of components having complex configurations using conventional powder metallurgy processes such as, for example, direct-hot isostatic pressing. Prior art direct-hot isostatic pressing of rhenium powder flake is described in an article entitled Development of Process Parameters for Manufacturing of Near-Net Shape Parts of Rhenium Using Hot Isostatic Pressing, Boris D. Bryskin, Victor N. Samarov, and Eugene P. Kratt, Rhenium and Rhenium Alloys, B. D. Bryskin, Editor, The Minerals, Metals & Materials Society, 1997, pp. 425–436, which is hereby incorporated by reference. In addition, the spherical powder according to the present invention can be used to form coatings via vacuum plasma spray deposition techniques, which are known. Furthermore, the spherical powders according to the invention can be used to fabricate components by directed light fabrication techniques such as are described in the article entitled Directed Light Fabrication of Rhenium Components, John O. Milewski, Dan J. Thoma, and Gary K. Lewis, Rhenium and Rhenium Alloys, B. D. Bryskin, Editor, The Minerals, Metals & Materials Society, 1997, pp.283–290, which is hereby incorporated by reference.

Various features and aspects of the present invention are illustrated further in the examples that follow. While these examples are presented to show one skilled in the art how to operate within the scope of this invention, they are not to serve as a limitation on the scope of the invention where such scope is only defined in the claims. Unless otherwise indicated in the following examples and elsewhere in the specification and claims, all parts and percentages are by weight, temperatures are in degrees centigrade and pressures are at or near atmospheric.

EXAMPLE 1

A cut of rhenium powder flake that would pass through 80 mesh sieve but not through 140 mesh sieve was entrained in a stream of argon/hydrogen (90% 10%) and fed into a Tekna induction plasma torch at a rate of 50 g/min. The flakes were melted in the reaction zone within the induction plasma torch and collected in a water cooled vessel. The resulting powder comprised spherical particles consisting essentially of rhenium having an average particle diameter of about 75 microns with a standard deviation of about 40 microns. The oxygen content of the resulting powder was about 270 ppm. The resulting powder had a Hall flow of about 4 seconds for a 50 g. sample.

EXAMPLE 2

A cut of rhenium powder flake that would pass through 140 mesh sieve but not through 325 mesh sieve was entrained in a stream of argon/hydrogen (90%/10%) and fed into a Tekna induction plasma torch at a rate of 50 g/min. The flakes were melted in the reaction zone within the induction plasma torch and collected in a water cooled vessel. The resulting powder comprised spherical particles consisting essentially of rhenium having an average particle diameter of about 37 microns with a standard deviation of about 17 microns. The oxygen content of the resulting powder was about 270 ppm. The resulting powder had a Hall flow of about 4 seconds for a 50 g. sample.

EXAMPLE 3

A cut of rhenium powder flake that would pass through 200 mesh sieve but not through 400 mesh sieve was entrained in a stream of argon/hydrogen (90%/10%) and fed into a Tekna induction plasma torch at a rate of 50 g/min. The flakes were melted in the reaction zone within the induction plasma torch and collected in a water cooled vessel. The resulting powder comprised spherical particles consisting essentially of rhenium having an average particle diameter of about 25 microns with a standard deviation of about 8 microns. The oxygen content of the resulting powder was about 270 ppm. The resulting powder had a Hall flow of about 4 seconds for a 50 g. sample.

EXAMPLE 4

A cut of rhenium powder flake that would pass through 200 mesh sieve but not through 635 mesh sieve was entrained in a stream of argon/hydrogen (90%/10%) and fed into a Tekna induction plasma torch at a rate of 50 g/min. The flakes were melted in the reaction zone within the induction plasma torch and collected in a water cooled vessel. The resulting powder comprised spherical particles consisting essentially of rhenium having an average particle diameter of about 10 microns with a standard deviation of about 5 microns. The oxygen content of the resulting powder was about 270 ppm. The resulting powder had a Hall flow of about 4 seconds for a 50 g. sample.

COMPARATIVE EXAMPLE 5

Rhenium powder flake that would pass through 200 mesh sieve but not through 400 mesh sieve was placed into a mold for producing a 0.75 in. diameter rod and compacted. A green density of 55% of the theoretical density of rhenium was obtained. The compacted rhenium powder flake was pre-sintered to a density of 75–80%. Upon final sintering, a density of 93% of theoretical density was obtained. The molded rod exhibited a shrinkage of about 33%.

EXAMPLE 6–7

Parts of the powder produced in Example 3 was mixed with 1 part of the powder produced in Example 4, injected into a mold for producing a 0.75 in. diameter rod, and compacted. A green density of 78% was obtained. The compacted powder was pre-sintered to a density of 84%. Upon final sintering, a density of 95.5% of theoretical density was obtained. The molded rod exhibited a shrinkage of only about 5%.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A powder comprising substantially spherical particles consisting essentially of at least about 10% by weight rhenium optionally allowed with up to about 90% by weight tungsten or up to about 60% by weight molybdenum, wherein said particles have an average diameter of from about 100 microns to about 300 microns.

2. A powder comprising substantially spherical particles consisting essentially of at least about 10% by weight rhenium optionally allowed with up to about 90% by weight tungsten or up to about 60% by weight molybdenum, wherein said particles have an average particle diameter of from about 60 to about 90 microns and a standard deviation of less than about 35 microns.

3. A powder comprising substantially spherical particles consisting essentially of at least about 10% by weight rhenium optionally allowed with up to about 90% by weight tungsten or up to about 60% by weight molybdenum, said powder having a Hall flow within the range of from about 3 to about 10 seconds for a 50 gram sample.

4. A powder comprising substantially spherical particles consisting essentially of rhenium, said powder having a bulk density within the range of from about 50% to about 70% of the theoretical density of rhenium.

5. A powder comprising substantially spherical particles consisting essentially of rhenium, said particles having an oxygen content of less than about 300 ppm.

6. A powder comprising substantially spherical particles consisting essentially of rhenium, said powder having a tap density within the range of from about 10 to about 14 g/cc.

7. A powder comprising substantially spherical particles consisting essentially of rhenium, said particles having an average diameter of about 75 microns with a standard deviation of about 40 microns or less.

8. A powder comprising substantially spherical particles consisting essentially of rhenium, said powder having a Hall flow of about 4 to about 6 seconds for a 50 gram sample, an average particle diameter of about 15 to about 35 microns with a standard deviation of about 12 microns or less, and a tap density of about 12 to about 13.5 g/cc.

9. The powder according to claim 8 wherein said particles contain less than about 300 ppm of oxygen.

* * * * *